United States Patent [19]

Griffith et al.

[11] 3,996,971

[45] Dec. 14, 1976

[54] NEEDLE LOOM AND METHOD FOR PRODUCING KNITTED ARTICLES

[75] Inventors: John Dalton Griffith, Sunderland; Robin Bidgood, Nuneaton, both of England

[73] Assignee: Bonas Machine Company Limited, Sunderland, England

[22] Filed: Sept. 30, 1975

[21] Appl. No.: 618,045

[30] Foreign Application Priority Data

Oct. 3, 1974 United Kingdom ..... 42867/74

[52] U.S. Cl. ..... 139/431; 139/118; 139/385

[51] Int. Cl.[2] ..... D03D 47/42; D03D 5/00

[58] Field of Search ..... 139/431, 432, 116, 195, 139/118, 385

[56] References Cited

UNITED STATES PATENTS

| | | | |
|---|---|---|---|
| 2,180,832 | 11/1939 | Libby | 139/431 |
| 3,261,361 | 7/1966 | Power | 139/118 |
| 3,456,692 | 7/1969 | Kronoff | 139/118 |
| 3,460,583 | 8/1969 | Mosher | 139/118 |
| 3,550,642 | 12/1970 | Des Rosiers | 139/432 |
| 3,908,708 | 9/1975 | Nogai | 139/431 |

*Primary Examiner*—James Kee Chi
*Attorney, Agent, or Firm*—James E. Nilles

[57] ABSTRACT

A needle loom for producing a decorative selvedge at the knitted edge of a fabric during weaving comprising a weft inserter for inserting loops of weft into a warp shed from one side, a knitting needle for securing the weft loops and movable weft loop engaging means for engaging selected weft loops and causing said selected weft loops to extend beyond the knitted edge of the fabric and forming a decorative edge.

The invention also includes a method producing a decorative selvedge on the aforesaid loom.

5 Claims, 7 Drawing Figures

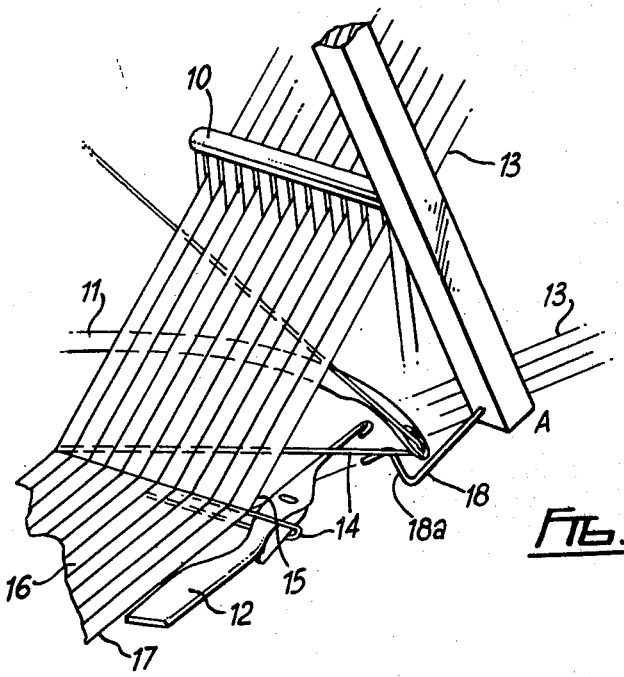
FIG. 1
FIG. 2
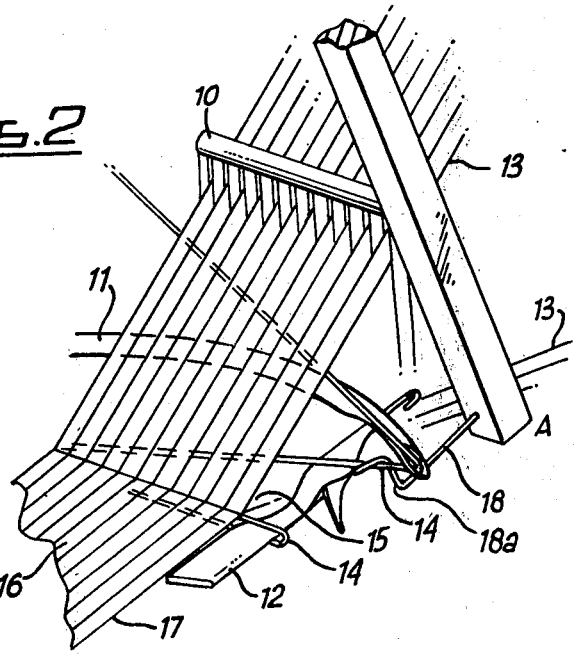

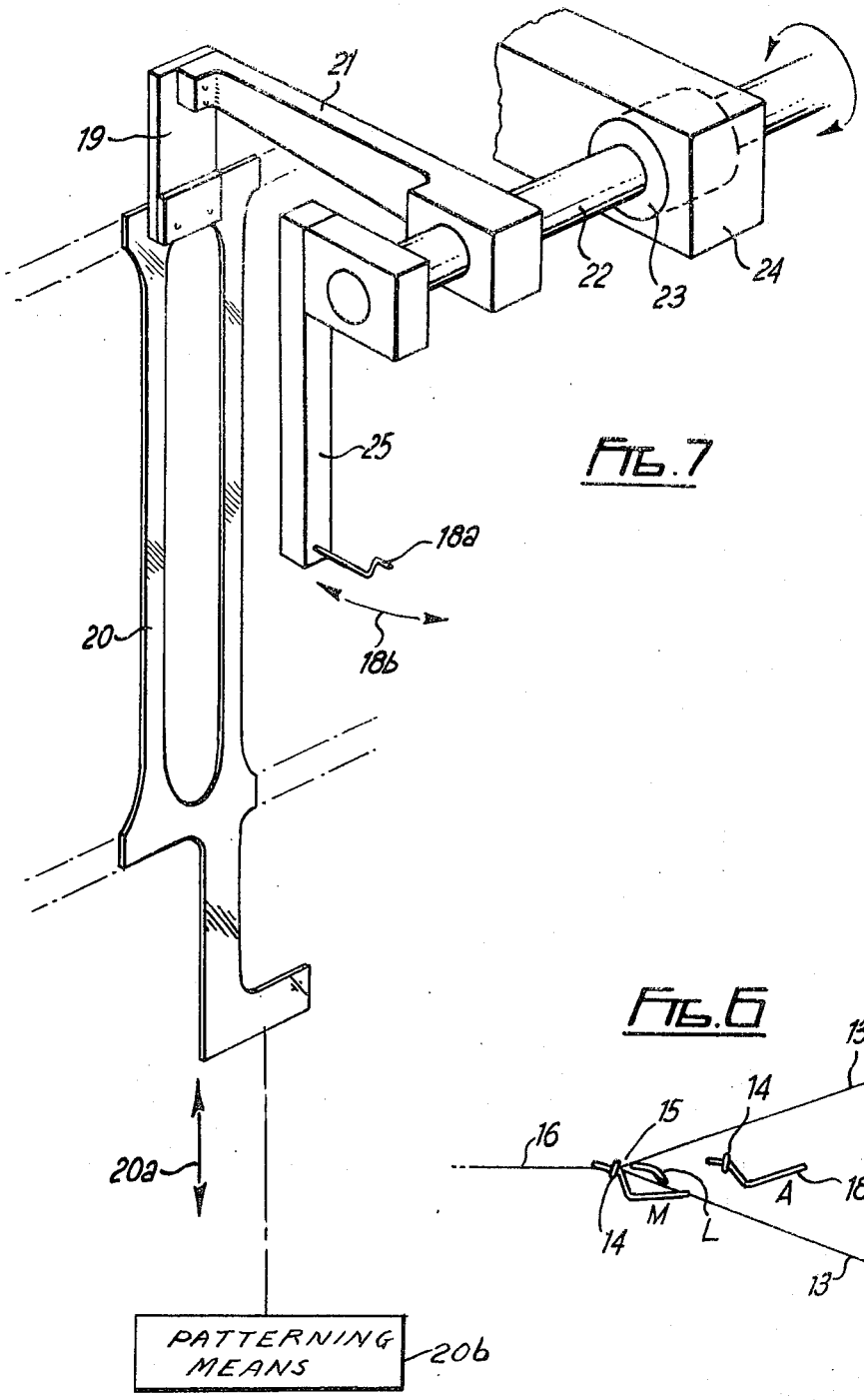
FIG. 7
FIG. 6
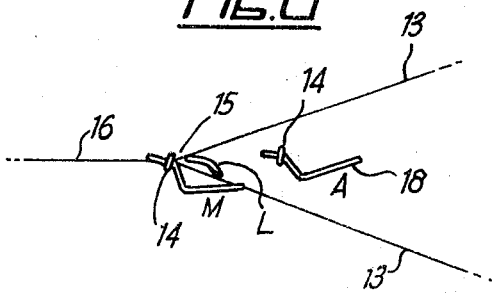

NEEDLE LOOM AND METHOD FOR PRODUCING KNITTED ARTICLES

This invention concerns looms and in particular narrow fabric looms of the kind (herein referred to as a 'needle loom') in which weft is inserted using a weft inserting needle, rapier or the like (herein referred to as a weft inserter) and fabrics produced thereon.

Needle looms are often provided, at the side thereof opposite to that from which weft is to be inserted, with a latch needle arranged to reciprocate alongside the edge of a fabric being woven to produce a knitted edge which serves to lock the inserted weft loops against removal from the fabric. In its simplest form, the knitted edge is formed simply by knitting one loop of weft through the next to produce a simple chain stitch selvedge.

When it is desired to produce a decorative selvedge such as a picot edge it is necessary to be able to vary the length of the loops of weft at that selvedge at which the decorative edge is to be produced. Heretofore it has been the usual practice to produce a decorative edge at that side of the fabric from which the weft inserter enters the shed. Such an edge can be produced using the so called 'edge wire' in known manner. It has not been possible to produce a decorative edge efficiently along the knitted selvedge of the fabric.

It is therefore a primary object of this invention to provide a loom including a means for producing a decorative edge with a high degree of consistency and efficiency at the knitted edge of a fabric.

A further object of the present invention is to produce a fabric with a knitted decorative edge.

Thus according to one aspect of the present invention there is provided a needle loom including heald frames and a means for producing a warp shed, a weft inserter needle (as herein defined) for inserting successive loops of weft into the shed from one side thereof and a knitting needle for securing successive loops of weft against removal from the fabric, and a beat-up means for beating up inserted weft loops, characterised in that there is provided a movable weft loop engaging means adjacent movable in synchronism with the knitting needle and adapted to engage at some of the inserted weft loops in a predetermined sequence thereby, in use, to produce loops of weft which extend beyond the knitted edge of the fabric thus to produce a decorative edge on the fabric.

According to a further aspect of the present invention there is provided a needle loom fabric having a decorative knitted edge.

According to a still further aspect of the present invention the method of producing a decorative edge on a needle loom fabric includes the steps of shedding a warp sheet, inserting successive loops of weft into successively formed sheds and producing a knitted selvedge at one edge of the fabric, including the step of producing a loop of weft of a length greater than that required for knitting, retaining the loop whilst carrying out a knitting operation, knitting at least one normal loop with the extended loop whilst the latter is retained in extended form and repeating a sequence of weaving and knitting to produce a decorative knitted edge along the fabric in which selected spaced loops of weft extend beyond the knitted edge of the fabric.

The invention will now be described further, by way of example only, with reference to the accompanying drawings in which:

FIGS. 1 to 4 inclusive are perspective, somewhat diagrammatic illustrations of part of a needle loom constructed in accordance with the invention and showing the positions of various elements of the needle loom during the production of a decorative edge along the fabric.

FIG. 6 is a diagrammatic side view showing the path of movement of a weft loop engaging element of the loom and, FIG. 7 is a perspective somewhat diagrammatic illustration showing one arrangement of actuating mechanism for the weft loop engaging element.

Figure 3:
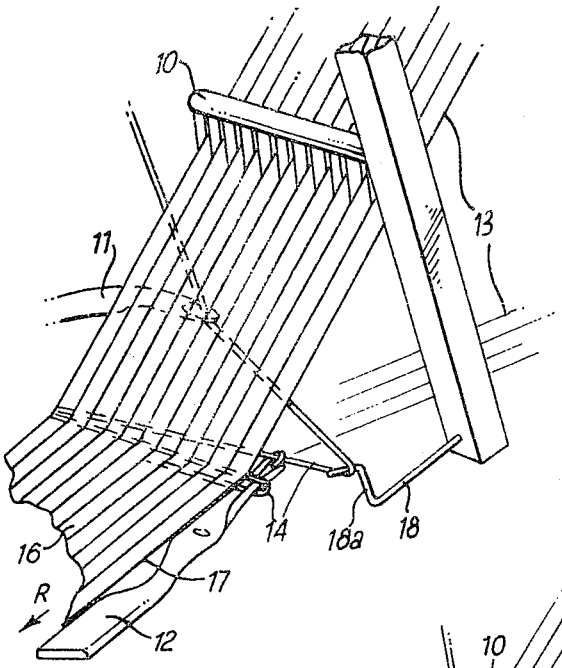

Referring first to FIGS. 1 to 4 inclusive, it will be seen that a loom is provided with a reed 10, a weft inserter 11 and a latch needle 12. As can be seen warp yarns 13 form successive sheds through which the weft inserter 11 can pass to carry successive loops of weft 14 through the sheds to be beaten up by the reed 10 into the fell 15 of the fabric 16.

The latch needle 12 reciprocates alongside the edge 17 of the fabric 16 in a manner such that at the appropriate part of its travel a weft loop 14 is engaged in the open hook of the latch needle 12. As the latch needle retracts in direction R (see FIG. 3) the weft loop 14 held in the hook of the latch needle is drawn through a previous weft loop 14 which, as shown in FIG. 2 has been located around the shank of the latch needle 12. Rearward movement of the latch needle 12 through the loop of weft on its shank causes (as shown in FIG. 3) the latch of the needle to close the hook to allow the loop 14 to slide off the needle over its hook and at the same time the closed hook retains the loop of weft 14 located therein to draw it through the previous loop 14. On the next forward movement of the latch needle 12 the loop 14 in the hook opens the latch and slides onto the shank of the needle 12.

At the appropriate part of the movement of the latch needle 12 the hook is positioned to engage the next loop of weft which has been inserted by the weft inserter 11 and so the next chain stitch can be formed during a repeat of the cycle of operations just described. This sequence of movements will produce a normal knitted selvedge as shown by loops G.H.J.K. of FIG. 5.

As can be seen from FIGS. 1 to 5 in particular the action of the latch needle 12 interknitting loops of weft 14 inserted into the shed by the weft inserter 11 to form a simple chain stitch serves to lock the inserted weft loops 14 against removal from the fabric.

Figure 4:
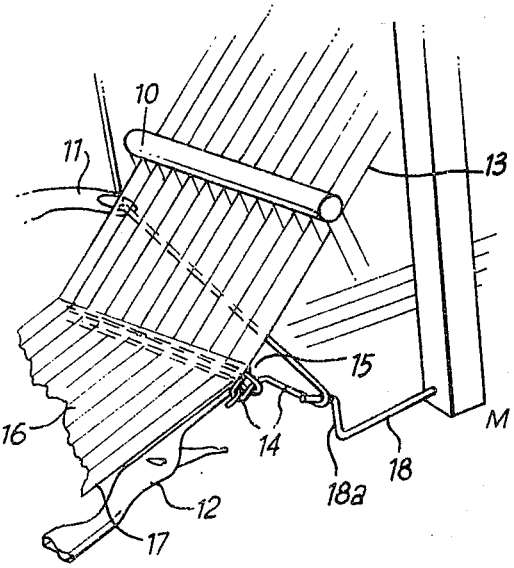

To produce the picot loops B. D and F shown in FIG. 5 and referring now to FIGS. 1, 2, 3, 4, 6 and 7 in in particular, there is provided a weft loop engaging finger 18 having a cranked free end 18*a*. This finger 18 is mounted such that it is capable of carrying out a motion substantially parallel to the knitted edge of the fabric. In a fully withdrawn position shown at A in FIGS. 1 and 2 the cranked end 18*a* of the loop engaging finger 18 will be in a position to be engaged by a loop of weft 14. The cranked end 18*a* of the finger 18 will engage the loop 14 adjacent to the free end of the weft inserter 11 when the latter is at or near the extremity of its travel through the warp shed as shown in FIGS. 1 and 2 and when, as shown in FIGS. 1 and 2 loop engaging finger 18 at the fully withdrawn position A. FIG. 4 shows the loop engaging finger at its other extreme position of movement M and FIG. 3 shows the loop engaging finger in an intermediate position. As can be seen the cranked end 18*a* of the finger 18, when the latter is in the position M shown in FIG. 4, lies substantially in alignment with the loop 14 of weft through which the latch needle 12 is being drawn. During movement of the latch needle 12 in the direction R the loop engaging finger 18 moves, at the same rate as the latch needle 12, towards the position M so that the weft is retained on the cranked end 18*a* of the finger 18.

The mechanism for actuating the loop retaining finger 18 is shown in FIG. 7 and as can be seen there is provided a flexible connecting member 19 attached to the top of a front frame 20 which is mounted in front of the forward heald frame (not shown). The frame 20 is thus nearer to the fell of the fabric than the front heald frame.

The frame 20 is mounted for slideable vertical movement as shown by the double headed arrow 20*a* in a manner somewhat similar to that of the heald frames of the loom. Movement of the frame 20 is controlled by a patterning means 20*b*.

To the upper part of the flexible connecting member 19 is attached an operating lever 21 which is rigidly fixed to a shaft 22 mounted in bearings 23 in a fixed bearing housing 24 mounted on the loom frame (not shown). To the shaft 22 is rigidly fixed a lever 25 which carries the loop engaging finger 18 at its free end.

Up and down motion in a vertical plane is imparted to the frame 20 by a known shed producing means such as a cam or pattern chain (not shown) in a suitable sequence whereby through the flexible connecting member 19 and operating lever 21 can cause the shaft 22 to oscillate in fixed bearing 23.

Oscillating motion of the shaft 22 will thus cause the loop retaining finger 18, mounted on lever 25 to oscillate as shown by the double headed arrow 18*b* of FIG. 7.

When it is desired to produce a normal knitted stitch it is necessary to ensure that the loop engaging finger 18 is so positioned as not to allow its cranked end 18*a* to engage a weft loop 14 and this can be achieved by providing a patterning means in which, for example, a cam or pattern chain is provided with a surface such that its follower will move the frame 20 to an intermediate position such that the loop engaging finger moves only to the position L (see FIG. 6) to disengage from the picot loop. The finger is then moved back to position M thus the next loop of weft when engaged by the hook of the latch needle will ride over the top of the cranked end 18*a* of the loop engaging finger 18 and thus a normal knitted stitch will be produced. Movement of the frame 20 to its upper limit will cause the loop engaging finger 18 to move to position A and movement of the frame 20 to a lower limit will cause the loop engaging finger to move to position M.

Figure 5:
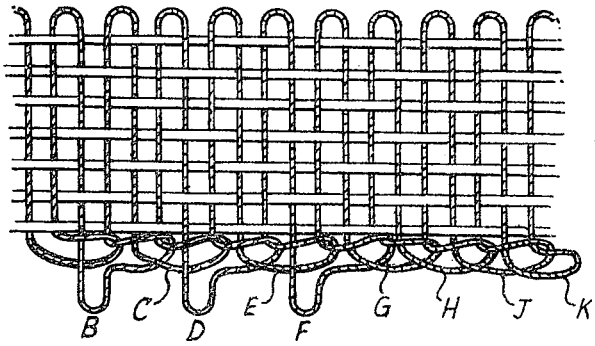
FIG. 5 is a very much enlarged plan view showing part of one form of fabric capable of being produced using the apparatus of FIGS. 1 to 4.

In operation assuming that there is to be provided a decorative 'picot' edge along the fabric as shown in FIG. 5 the previously described loop engaging finger 18 is moved to its fully withdrawn position A as shown in FIGS. 1, 2 and 6 shortly before the weft inserter 11 arrives at its fully inserted position shown in FIG. 2. FIG. 1 shows the weft inserter just prior to its fully inserted position.

As shown in FIG. 1 the weft inserter 11 lays the loop of weft 14 across the top of the finger 18, but as the weft inserter 11 moves to its fully inserted position, part of the said weft loop 14 becomes located below the finger 18 as shown in FIG. 2.

The finger 18 then moves towards the fell 15 of the fabric and substantially parallel to the knitted edge of the fabric 17.

As previously described the said weft loop 14 is engaged in the open hook of the latch needle 12 as shown in FIG. 3.

FIGS. 4 and 6 show the finger 18 in the fully inserted position M but still retaining the loop of weft 14 at a predetermined distance from the edge 17 of the fabric 16. The position of the finger 18 relative to the edge of the fabric will determine the size of the 'picot' loops produced.

As shown in FIGS. 3 and 4 the weft needle has been returning to its fully withdrawn position in readiness for the next insertion.

With the latch needle in this position the weft loop in its hook has been drawn through the previously formed loop and the picot loop is retained by the finger 18. Thus a 'picot' loop B as shown on FIG. 5 is formed. The finger 18 is left in engagement with the loop B until another normal pick or chain stitch G has been produced and interknitted with said loop B.

The finger 18 is now caused to move to its fully withdrawn position A as shown in FIGS. 1, 2 and 6.

The previous cycle is now repeated twice to form picot loops D and F followed by normal chain stitch loops H, J and K respectively.

If it is a requirement that further consecutive normal chain stitch loops are to be produced then the finger 18 is caused to withdraw to position L in FIG. 6 to clear "picot" loop F and then returns to its fully inserted position M (FIGS. 4 and 6) alongside the fell 15. The finger 18, due to the patterning mechanism then remains stationary until it is required to take up position A to engage another 'picot' loop.

This rearward and forward movement of the finger 18 between positions L and M takes place in a timed relationship to the weft inserter 11 such that there is no possibility of engaging a loop of weft 14 which is to be normally knitted, on the cranked end 18*a* of finger 18.

It is a requirement of the present invention that after a 'picot' loop such as B, D or F has been formed it must be followed by at least one normal knitted chain stitch such as G, E and H and that the finger 18 must be left in engagement with the 'picot' loop while at least one subsequent normal chain stitch is knitted.

Clearly many other forms of decorative edge can be produced by this means, for example, the 'picot' loop can be made smaller or larger by the positioning of the loop retaining finger 18 near to or away from the knitted edge 17 of the fabric 16. The invention thus makes it possible to produce a fringe of constant length loops along the whole length of the knitted edge of the fabric, there being a picot loop alternating with a normal knitted loop along the fabric edge or alternatively a discontinuous fringe may be produced by causing the finger 18 only to engage spaced apart loops 14 in any predetermined pattern.

If desired fabrics may be woven one above the other. To achieve this the weft inserter carrying arm is provided with two weft inserters the latch needle carrier is provided with two latch needles and the loop engaging finger carrying arm is provided with two loop engaging fingers. This will allow two fabrics to be woven. In looms in which two fabrics can be woven side-by-side, the modification just referred to will enable four fabrics to be woven.

What we claim is:

1. A needle loom including heald frames and a means for producing a warp shed, a weft inserter needle for inserting successive loops of weft into the shed from one edge thereof and a knitting needle at the other edge for securing successive loops of weft against removal from the fabric, a beat-up means for beating up inserted weft loops, and a movable weft loop engaging means adjacent to and movable in synchronism with the knitting needle and adapted to engage at least some of the inserted weft loops in a predetermined sequence thereby to produce decorative loops of weft extending beyond the knitted edge of the fabric.

2. A needle loom as claimed in claim 1 wherein the weft loop engaging means includes a weft loop engaging finger having a cranked free end to engage selected weft loops, a lever adapted to oscillate in a plane parallel to the plane of reciprocation of the knitting needle, said lever supporting the finger, and said lever being mounted upon a shaft carrying an operating lever attached to a vertically slidable frame mounted in the loom between the reed and the heald frame nearest thereto.

3. A needle loom as claimed in claim 2 further including means for connecting the operating lever to the slidable frame, the means for connecting including a flexible connecting member.

4. A needle loom as claimed in claim 2 in which the slidable frame is associated with a patterning means which latter is adapted to control the sequence of movements of the slidable frame.

5. The method of producing a decorative knitted edge on a needle loom fabric produced on a needle loom including the steps of shedding a warp sheet, inserting successive loops of weft into successively formed sheds and producing a knitting selvedge at one edge of the fabric, including the step of producing a loop of weft of a length greater than that required for knitting, retaining the loop while carrying out a knitting operation, knitting at least one normal loop with the extended loop while the latter is retained in extended form and repeating a sequence of weaving and knitting to produce a decorative knitted edge along the fabric in which selected spaced loops of weft extend beyond the knitted edge of the fabric.

* * * * *